US005886641A

United States Patent [19]

Ulerich et al.

[11] Patent Number: 5,886,641

[45] Date of Patent: Mar. 23, 1999

[54] TRIP INDICATOR AND SIGNALLING SWITCH ASSEMBLY

[75] Inventors: Phillip L. Ulerich, Pittsburgh, Pa.; Gregory D. Tallman, Belding, Mich.

[73] Assignee: Eaton Corporation, Cleveland, Ohio

[21] Appl. No.: 58,064

[22] Filed: Apr. 9, 1998

[51] Int. Cl.[6] ..... G08B 21/00

[52] U.S. Cl. ..... 340/638; 335/17; 335/14; 335/172

[58] Field of Search ..... 340/638, 644; 335/17, 14, 6, 20, 172, 175, 167–176; 361/115, 102; 324/424; 200/400, 401

[56] References Cited

U.S. PATENT DOCUMENTS 4,931,758 6/1990 Bagalini ..... 335/174
5,453,724 9/1995 Seymour et al. ..... 335/172

OTHER PUBLICATIONS

Merlin Gerin: Masterpact Technical Manual –Universal Power Breaker; 4pgs. (Jul. 1988).

*Primary Examiner*—Jeffrey A. Hofsass
*Assistant Examiner*—Sihong Huang
*Attorney, Agent, or Firm*—Martin J. Moran

[57] ABSTRACT

A circuit breaker with trip indicator assembly for indicating the trip status of the circuit breaker. The trip indicator assembly includes a spring powered shaft movable between a cocked position and a trip position in which the spring powered shaft protrudes through the housing of the circuit breaker to indicate the trip status. The shaft is operatively connected to a trip actuating mechanism of the circuit breaker so as to actuate the shaft in response to the trip actuating mechanism actuating an operating mechanism of the circuit breaker. A lost motion coupling is provided to assure that the trip indicator assembly is not actuated until after actuation of the operating mechanism. A bell alarm switch assembly for signalling the trip status of the circuit breaker may be operatively connected to the trip indicator assembly.

26 Claims, 7 Drawing Sheets

TRIP INDICATOR AND SIGNALLING SWITCH ASSEMBLY

BACKGROUND OF THE INVENTION

Field of the Invention

This invention relates to circuit breakers, and more particularly, to a circuit breaker having a trip indicator for indicating the trip status of the circuit breaker and/or a bell alarm switch for signalling the trip status of the circuit breaker.

Background Information

Circuit breakers having an electrically insulating housing, separable electrical contacts movable between a closed and open position, an operating mechanism for operating the separable electrical contacts, and a tripping mechanism operatively connected to the operating mechanism are generally known in the art. Typically, the tripping mechanism senses an electrical condition, such as an overcurrent, and actuates the operating mechanism in response thereto so as to trip open the separable electrical contacts. As the separable electrical contacts, the operating mechanism, and the tripping mechanism are contained within the housing of the circuit breaker, it is usually not possible to visually inspect the circuit breaker and determine if a tripping operation has occurred. Accordingly, such circuit breakers may be equipped with a means for indicating, either locally or to a remote location, that a tripping operation has occurred. Such means for indicating the trip status may take the form of a mechanical or an electrical indicator.

An example of a mechanical indicator is a "flag" that appears in a window or opening formed in the housing of the circuit breaker following a tripping operation. The flag may be mechanically linked to the operating mechanism and/or tripping mechanism resulting in the flag becoming visible following a tripping operation. Another type of mechanical indicator may include a reset button which visually indicates that a trip has occurred. However, the reset button may need to be manually reset following a tripping operation prior to the circuit breaker being placed back into operation. Such an indicator is not desirable in situations where it is desired or advantageous to place the circuit breaker back into operation from a remote location.

An example of an electrical indicator is a remote signalling switch positioned within the breaker. Typically, a bell alarm switch is provided that sends a signal indicating that the circuit breaker has tripped. A disadvantage of providing a remote signal via a bell alarm switch is that a visual inspection of the circuit breaker may not reveal that the circuit breaker has tripped.

Typically, mechanical and electrical indicators are separate components that are actuated individually by separate mechanisms. This results in the need for increased space in the circuit breaker when mechanical and electrical indicators are employed. In addition, costs are increased by such an arrangement.

There is a need, therefore, for an improved means for mechanically indicating that a circuit breaker has tripped.

There is a related need for a mechanical indicator which can be implemented easily together with an electrical indicator, such as a bell alarm switch.

There is a further need for such trip indicators that can be incorporated into circuit breaker designs without interfering with the normal operation of the circuit breaker.

There is an additional need for such an arrangement which is flexible enough to allow for varied customer requirements for indicating trip status of a circuit breaker.

SUMMARY OF THE INVENTION

These needs and others are satisfied by the invention which is directed to a circuit breaker having a trip indicator assembly for indicating the trip status of the circuit breaker. The trip indicator assembly is incorporated into a circuit breaker having, as is generally known, an electrically insulative housing, separable electrical contacts disposed within the housing and movable between a closed position and an open position, an operating mechanism for operating the separable electrical contacts, and a trip actuating mechanism for actuating the operating mechanism in order to trip open the separable electrical contacts. The circuit breaker also includes a trip unit for sensing an electrical condition of the separable electrical contacts, wherein the trip unit is capable of sending a trip signal in response to a predetermined electrical condition, such as an overcurrent.

The trip indicator assembly includes a spring powered shaft which is movable between a cocked position and a trip position in which the spring powered shaft protrudes through an opening formed in the housing of the circuit breaker. The trip indicator assembly also includes a means for releasably retaining the spring powered shaft in the cocked position. The trip indicator assembly further includes a release rod having a first end operatively connected to the trip actuating mechanism of the circuit breaker and a second end positioned adjacent the spring powered shaft. Due to the connection between the first end of the release rod and the trip actuating mechanism, the release rod is movable in response to actuation of the trip actuating mechanism. Movement of the release rod results in the second end thereof engaging the spring powered shaft following actuation of the trip actuating mechanism. This engagement between the second end of the release rod and the spring powered shaft results in the spring powered shaft being released from engagement with the means for releasably retaining the spring powered shaft in the cocked position. As can be appreciated, this allows the spring powered shaft to move to the tripped position. Advantageously, the protrusion of the spring powered shaft through the housing of the circuit breaker while in the tripped position provides a visual indication that the circuit breaker has tripped.

In a preferred embodiment of the invention, an additional actuating mechanism is provided for actuating the operating mechanism. The circuit breaker also includes a rigid link member for operatively connecting the first end of the release rod to a rotatable tripper platform which forms part of the trip actuating mechanism. Upon actuation of the trip actuating mechanism, the rotatable tripper platform rotates to operate the operating mechanism, but the rotatable tripper platform does not rotate when the additional actuating mechanism operates the operating mechanism. Advantageously, this allows for the operating mechanism to be operated by the additional actuating mechanism in order to take the circuit breaker out of operation, i.e., open the separable electrical contacts, without actuating the trip indicator assembly.

The rigid link member is, preferably, connected to the rotatable tripper platform by a lost motion coupling which provides for lost motion between the release rod and the trip actuating mechanism. Advantageously, the lost motion coupling allows the trip actuating mechanism to operate the operating mechanism and trip the separable electrical contacts open prior to the rotatable tripper platform causing the release rod to be moved and the trip indicator assembly to be actuated.

The invention may also include at least one bell alarm switch capable of signalling the trip status of the circuit breaker. A bell alarm actuator means is provided for actuating the at least one bell alarm switch. In the preferred embodiment of the invention, the bell alarm actuator means is operatively connected to the spring powered shaft for actuating the at least one bell alarm switch responsive to the spring powered shaft moving from the cocked position to the trip position. Advantageously, the bell alarm switch provides for additional and enhanced trip indicating capabilities.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
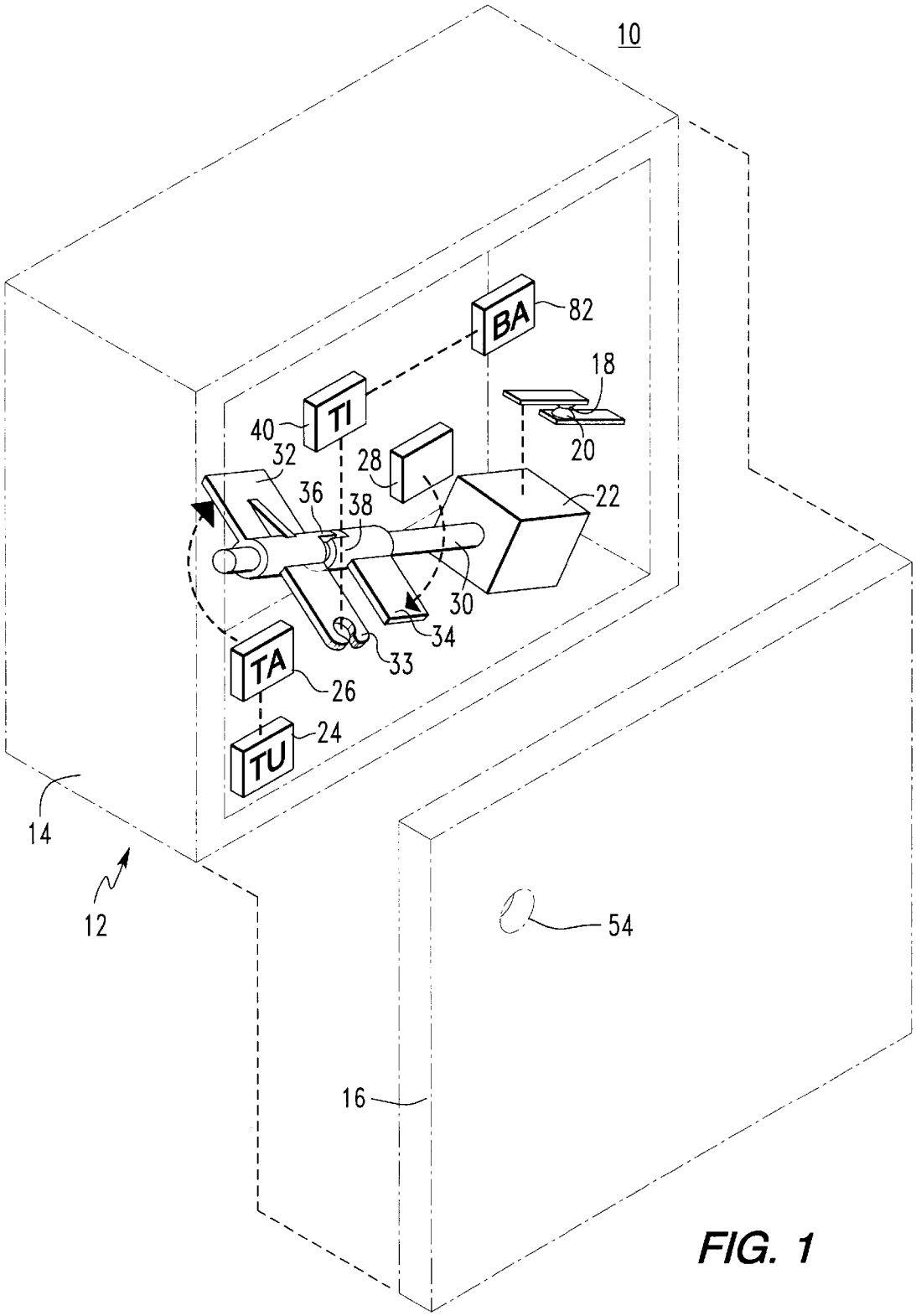
FIG. 1 is an isometric view schematically illustrating the circuit breaker of the invention.

Referring to FIG. 1, there is shown a circuit breaker 10 of the invention with selected components schematically illustrated. The circuit breaker 10 is comprised of an electrically insulative housing, generally designated by reference numeral 12, which includes a base 14 and a cover 16. The circuit breaker 10 further includes separable electrical contacts 18 and 20 disposed within the base 14 of housing 12 and movable between a closed position and an open position. An operating mechanism 24 is provided for closing, opening, and tripping open the contacts 18 and 20. A trip unit 24 is provided for sensing an electrical condition of the contacts 18 and 20, wherein the trip unit 24 is capable of sending a trip signal in response to a predetermined electrical condition, such as an overcurrent. The circuit breaker 10 further includes a trip actuating mechanism 26 that is operatively connected to the operating mechanism 22. The trip actuating mechanism 26 is capable of receiving the trip signal from the trip unit 24 and actuating the operating mechanism 22 in response thereto so as to trip open the contacts 18 and 20. The circuit breaker 10 may also include an additional actuating mechanism 28 for actuating the operating mechanism 22. The additional actuating mechanism 28 provides for opening the contacts 18 and 20 to place the circuit breaker 10 in an off position. Both the trip actuating mechanism 26 and the additional actuating mechanism 28 may be, for example, operatively connected to the operating mechanism 22 by a trip bar 30. The components of the circuit breaker 10 described thus far are basic circuit breaker components that are generally known in the art and, therefore, these components are not described in detail herein.

Further referring to FIG. 1, there is shown a rotatable tripper platform 32 for operatively connecting the trip actuating mechanism 26 to the operating mechanism 22. An additional platform 34 is also shown for operatively connecting the additional actuating mechanism 28 to the operating mechanism 22. The tripper platform 32 is rotatably mounted on but not rigidly connected to the trip bar 30. In contrast, the additional platform 34 is rigidly secured to the trip bar 30. Thus, upon actuation of the additional actuating mechanism 28 the additional platform 34 is operated so as to actuate the operating mechanism 22. However, it will be appreciated that operation of the additional platform 34 does not result in rotation of the tripper platform 32. The tripper platform 32 is only rotated following actuation of the trip actuating mechanism 26.

When the tripper platform 32 is rotated, an arm 36 of the tripper platform 32 cooperates with an additional arm 38 of the additional platform 34 resulting in the rotation of the trip bar 30 and the actuation of the operating mechanism 22. It will, therefore, be appreciated that tripper platform 32 will only be rotated during a tripping operation of the circuit breaker 10.

Referring to FIGS. 2–5, there is set forth a trip indicator assembly, generally designated by reference numeral 40, for indicating the trip status of the circuit breaker 10. The trip indicator assembly 40 may be integrally formed as part of the housing 12, or as shown in the preferred embodiment may be separately formed and inserted into the housing 12. For example, the trip indicator assembly 40 may be a modular unit provided as an option and separately mounted to the housing 12. As shown, the modular unit would include a support frame 42 having a base 43, a cover 44, first sidewall 46 (FIG. 2), second sidewall 47 (FIG. 6) and back wall 48.

Figure 3:
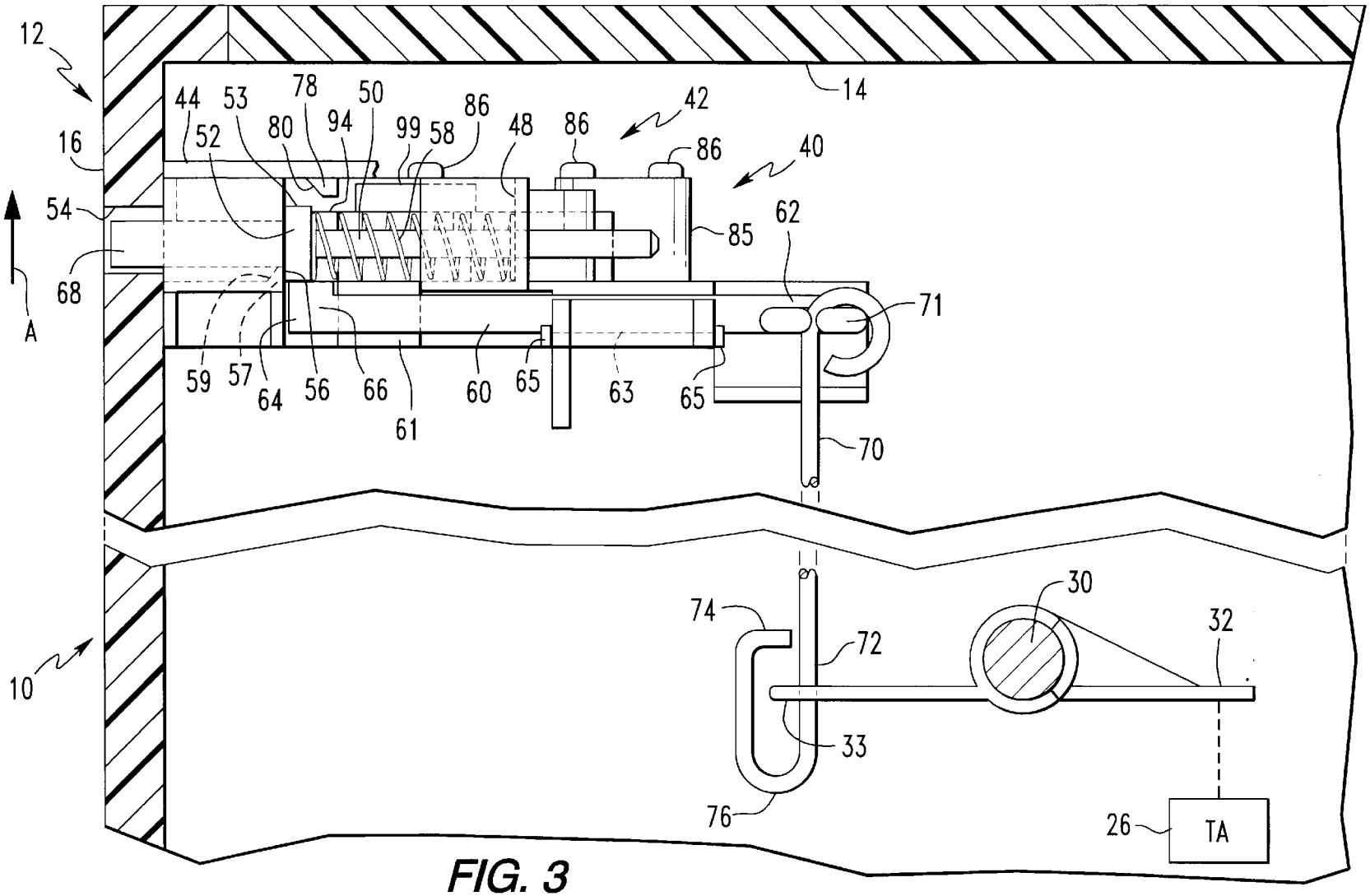
FIG. 3 is a side view of the trip indicator assembly, with parts removed for simplicity, the trip indicator assembly being shown in the cocked position.
Figure 4:
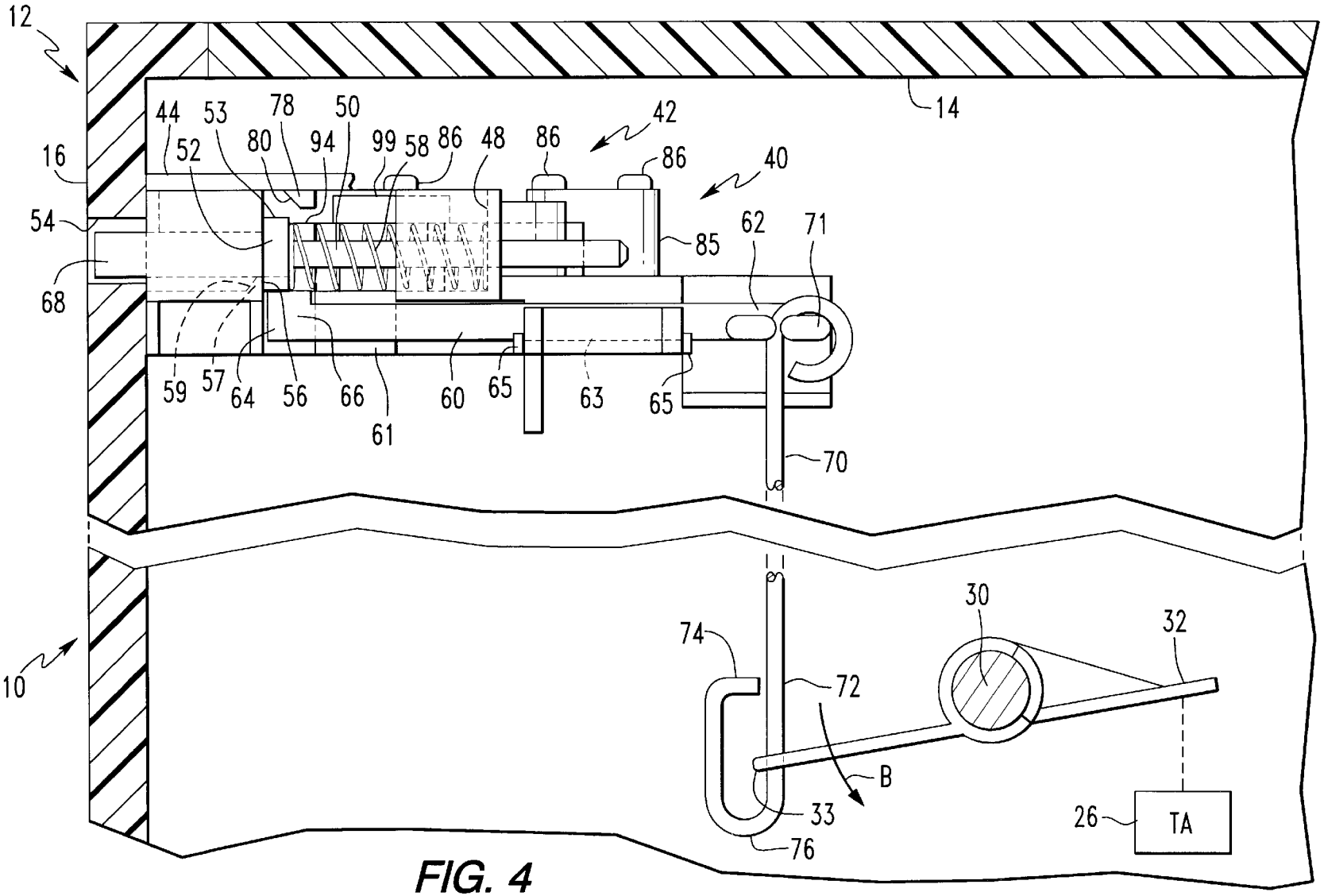
FIG. 4 is a side view of the trip indicator assembly, similar to FIG. 3, following actuation of the trip actuating mechanism and the operating mechanism, but showing the trip indicator still in the cocked position.

The trip indicator assembly 40 further includes a shaft 50 having a radial projection in the form of an annular flange 52. The shaft 50 is movable between a cocked position (FIG. 3) and a trip position (FIG. 5) in which the shaft 50 protrudes through an opening 54 formed in the cover 16 of housing 12. As shown in FIG. 3, the shaft 50 is releasably retained in the cocked position due to engagement between the annular flange 52 and a catch surface 56 which is formed as a shoulder on a first guide surface 57 of the trip indicator assembly 40. The first guide surface 57 also includes a cooperating first camming surface 59 for assisting in resetting assembly 40, as will be described herein. The engagement between the radial projection 52 and the catch surface 56 is maintained by a helical compression spring 58 that is positioned between the backwall 48 and the annular flange 52. The spring 58 biases the annular flange 52 into engagement with the catch surface 56.

The trip indicator assembly 40 further includes a release rod 60 having a first end 62 operatively connected to the trip actuating mechanism 26. The release rod 60 also includes a second end 64 having a lateral projection 66 formed thereon. The lateral projection 66 is positioned adjacent the annular flange 52 of shaft 50 so that following actuation of the trip actuating mechanism 26, the lateral projection 66 will engage the annular flange 52 to laterally displace the annular flange 52 in a first direction as indicated by arrow A. Release rod 60 is supported by support block 61 and retained within channel 63 which are formed as part of the base 43. Retaining tabs 65 are formed on rod 60 to longitudinally position rod 60. The channel 63, along with first sidewall 46 (FIG. 2), serve to keep the rod 60 properly positioned within the assembly 40. Preferably, the rod 60 is caused to rotate about a longitudinal axis thereof following actuation of the trip actuating mechanism 26. This rotation of rod 60 is what initiates contact between the lateral projection 66 and the annular flange 52 causing the lateral displacement of annular flange 52. This lateral displacement of the annular flange 52 results in the disengagement or release of the annular flange 52 from engagement with the catch surface 56. As can be appreciated, the shaft 50, as a result of the biasing action provided by spring 58, is then allowed to move to the trip position (FIG. 5).

Figure 5:
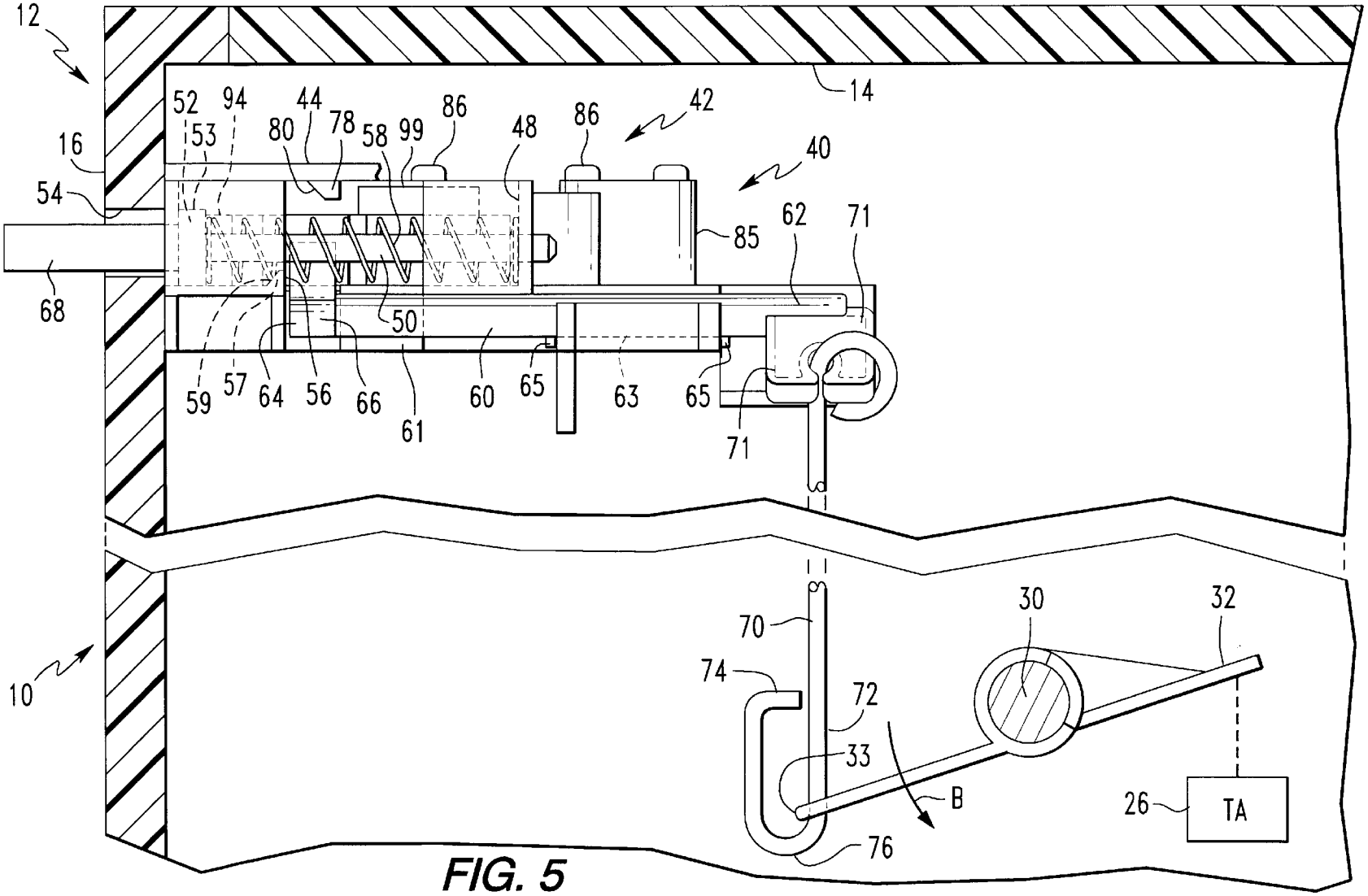
FIG. 5 is a side view of the trip indicator assembly, similar to FIGS. 3 and 4, only showing the trip indicator assembly in the trip position.

As shown in FIG. 5, movement of the shaft 50 to the trip position results in an indicator end 68 of shaft 50 protruding through opening 54 to provide a visual indication that a tripping operation has occurred within the circuit breaker 10.

Still referring to FIGS. 2–5, there is shown a rigid link member 70 for operatively connecting the first end 62 of release rod 60 to the trip actuating mechanism 26. Preferably, the first end 62 includes a lever arm 71 to which the link member 70 is connected in order to rotate rod 60 as a result of a load being applied to the lever arm 71 through link member 70. The rigid link member 70 includes a lost motion coupling 72 to provide for lost motion between the release rod 60 and the trip actuating mechanism 26. The lost motion is accomplished by connecting the lost motion coupling 72 to a first end 33 of the tripper platform 32.

The lost motion coupling 72 allows the trip actuating mechanism 26 to actuate the operating mechanism 22 in order to trip open the electrical contacts 18 and 20 prior to the rigid link member 70 causing the release rod 60 to be moved. As previously described, the trip unit 24 sends a trip signal to the trip actuating mechanism 26 which in turn causes the tripper platform 32 to rotate and actuate the operating mechanism 22. Rotation of the tripper platform 32 in order to actuate the operating mechanism 22 results in the first end 33 of the tripper platform 32 traveling from a top portion 74 of the lost motion coupling 72 downward toward a bottom portion 76, as indicated by arrow B and shown in FIG. 4. When the first end 33 of tripper platform 32 generally reaches the position shown in FIG. 4, the operating mechanism 22 will have been actuated. However, the movement of the first end 33 of tripper platform 32 from the position adjacent the top portion 74 (FIG. 3) toward the lower portion 76 (FIG. 4) does not result in the movement or rotation of the release rod 60. It will be appreciated that due to the non-movement of release rod 60, the shaft 50 of trip indicator assembly 40 is not released from the cocked position (see FIG. 4).

Once the tripper platform 32 has been sufficiently rotated to actuate the operating mechanism 22, the trip actuating mechanism 26 continues to rotate the tripper platform 32 in the direction indicated by arrow B until such time as the first end 33 of tripper platform 32 engages the lower portion 76 of lost motion coupling 72 (FIG. 5). The engagement between the first end 33 of tripper platform 32 and the lower portion 76 results in a load being applied to the lever arm 71 resulting in the rotation of release rod 60. As previously described, rotation of the release rod 60 results in the lateral projection 66 laterally displacing the annular flange 52 of shaft 50 so as to release the annular flange 52 from engagement with the catch surface 56. The spring 58 then causes the shaft 50 to move to the trip position with the indicator end 68 of shaft 50 extending through the front cover 16 to indicate that a trip has occurred (FIG. 5).

The employment of the lost motion coupling 72 and the tripper platform 32 to operatively connect the trip actuating mechanism 26 and the release rod 60 advantageously allows for the trip actuating mechanism 26 to actuate the operating mechanism 22 in order to trip open the electrical contacts 18 and 20 prior to the trip indicator assembly 40 being actuated to indicate that a trip has occurred. During this sequence of events, which occur almost instantaneously, the actuation of the operating mechanism 22 by the trip actuating mechanism 26 in order to open the contacts 18 and 20 is the most important event that needs to take place first. By employing the above described aspects of the invention, the trip actuating mechanism 26 is allowed to actuate the operating mechanism 22 prior to the actuation of the trip indicator assembly 40. Only after the operating mechanism 22 has been actuated is the additional load applied to the tripper platform 32 to cause movement of the release rod 60 to actuate the trip indicator assembly 40.

Figure 2:
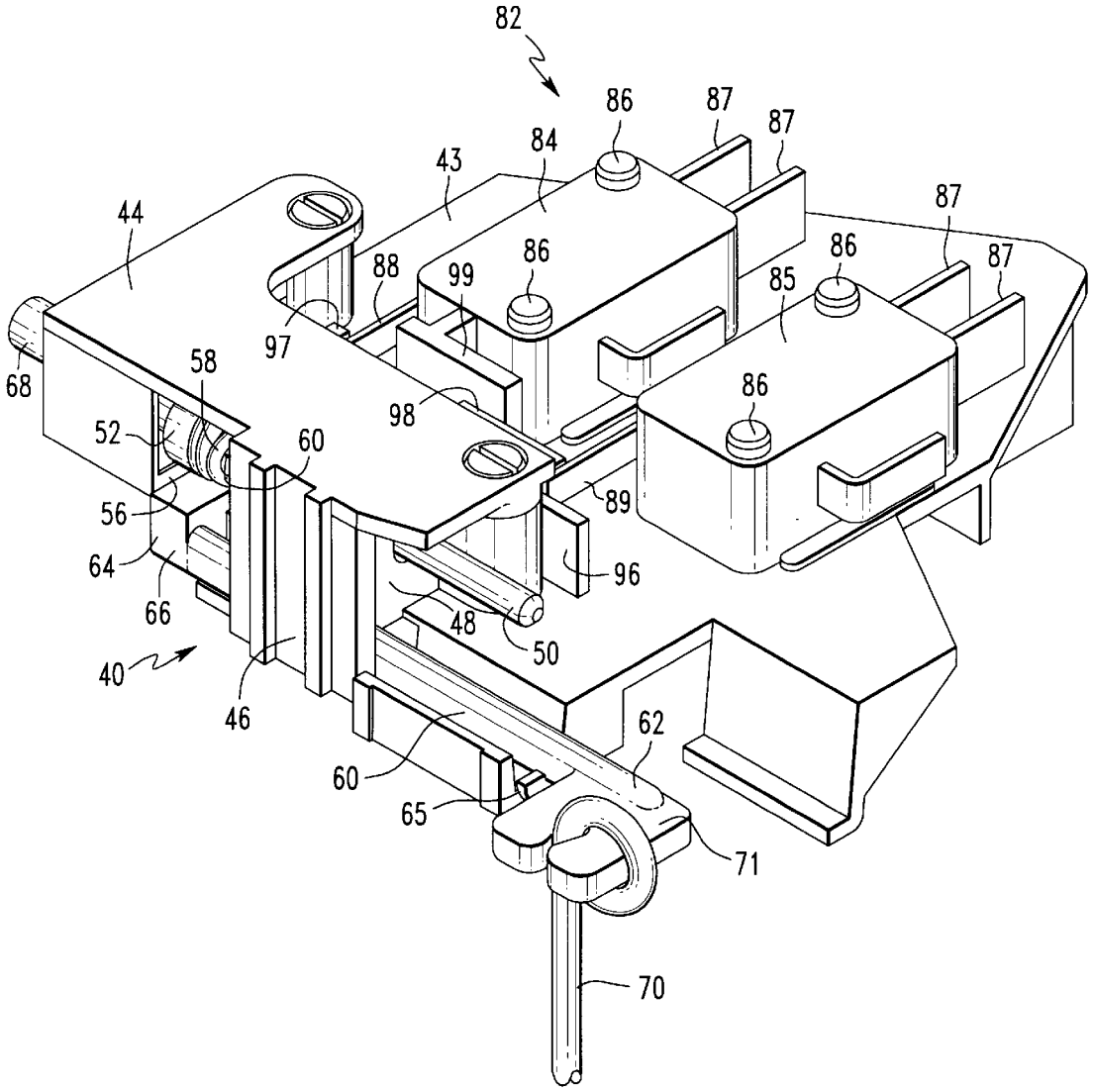
FIG. 2 is an isometric view of the trip indicator assembly and bell alarm switch assembly of the invention.

Following rotation of the tripper platform 32 by the trip actuating mechanism 26 to actuate assembly 40, the tripper platform 32 returns to the position shown in FIG. 2. The top portion 74 and lower portion 76 of the lost motion coupling 72 is allowed to move freely with respect to the first end 33 of tripper platform 32. Advantageously, this allows for the operating mechanism 22 to be operated to close the contacts 18 and 20 and to place the circuit breaker 10 back into operation without the need for resetting the trip indicator assembly 40, which must be manually reset as will be described herein. This is important when it is desired to place the circuit breaker 10 back into operation from a remote location following a tripping operation without first manually resetting assembly 40.

Following a tripping operation and the trip indicator assembly 40 being actuated to indicate the occurrence of the tripping operation, the trip indicator assembly 40 may be reset to the cocked position by manually pushing the indicator end 68 of shaft 50 inward towards the front cover 16. During this resetting operation, the annular flange 52 engages first camming surface 59 of first guide surface 57 so that a top surface 53 of the annular flange 52 is aligned for engagement with a second guide tab 78 having a second camming surface 80 for engaging the annular flange 52 and directing it downward in a second direction, generally opposite to the first direction A, for engagement with the catch surface 56. This places the shaft 50 into the cocked position for further operation. In addition, the annular flange 52 contacts the lateral projection 66 of the rod 60 causing rod 60 to rotate in a reverse direction. This results in the rod 60, and particularly the lever arm 71, to be reset for further operation.

Figure 6:
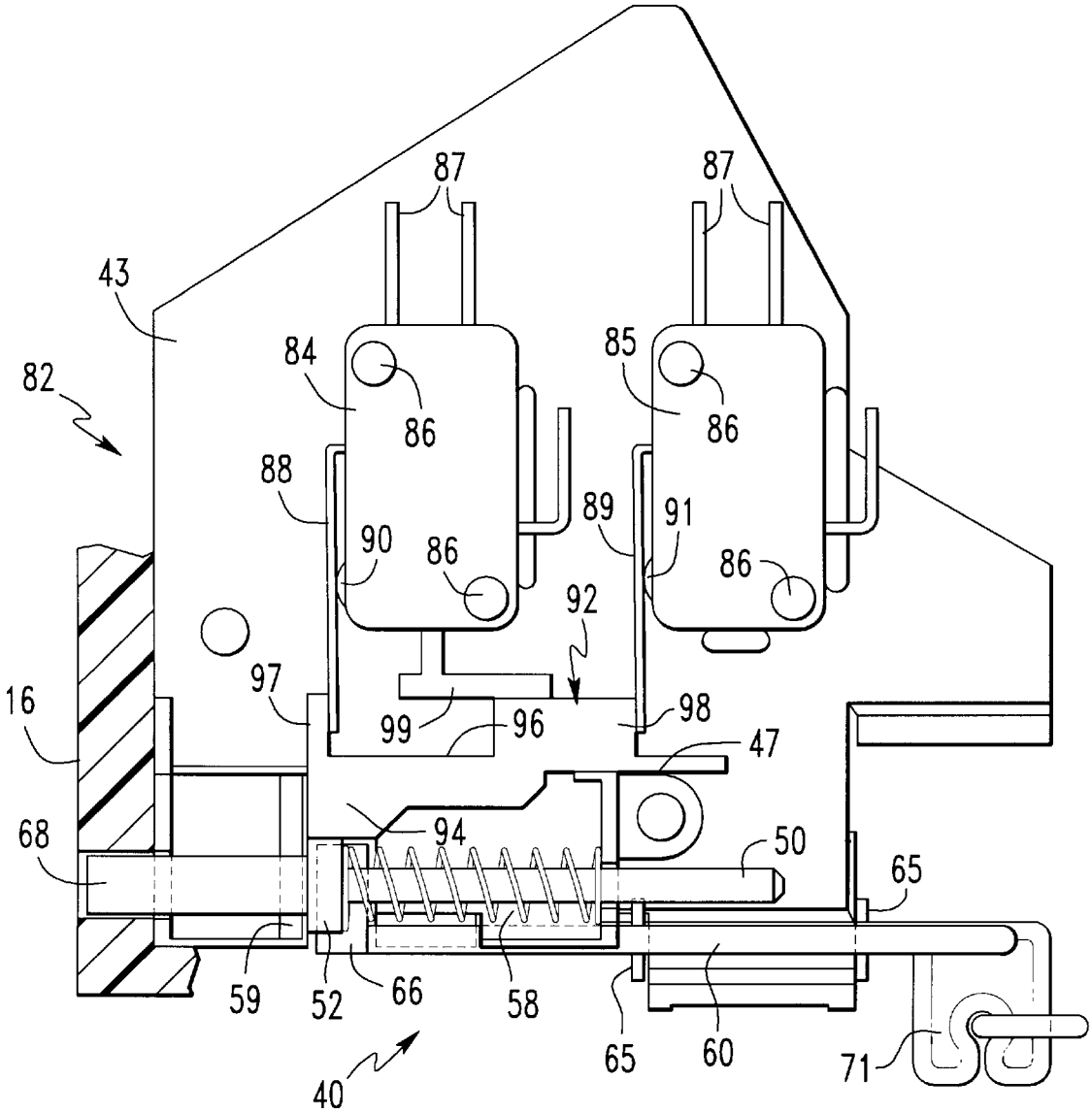
FIG. 6 is a plan view of the trip indicator assembly and bell alarm assembly in the cocked position, with parts removed for simplicity.
Figure 7:
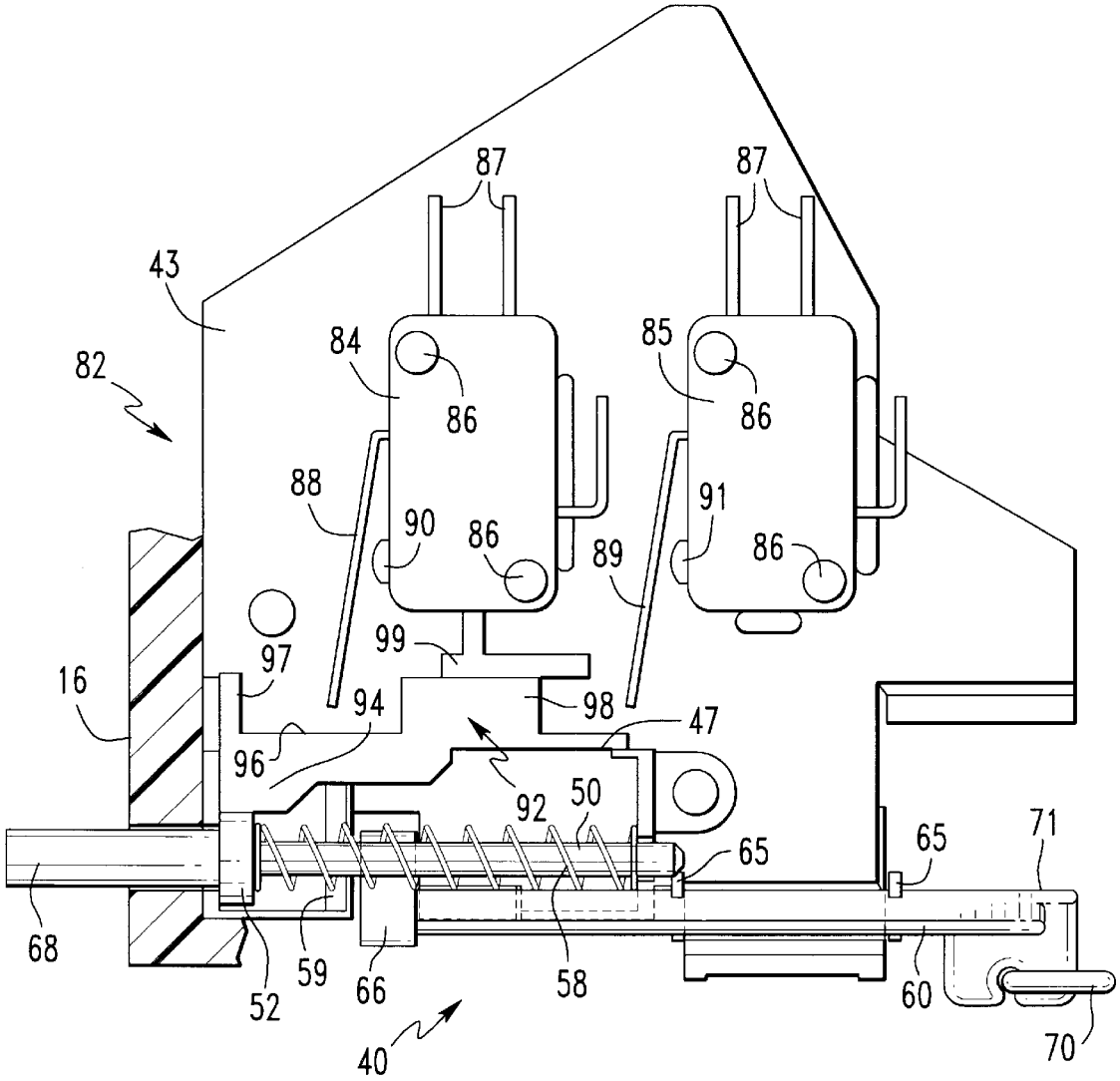
FIG. 7 is a plan view of the trip indicator assembly and bell alarm assembly, similar to FIG. 6, in the trip position.

Referring to FIGS. 6 and 7 there is shown a bell alarm switch assembly, generally designated by reference numeral 82, for signalling the trip status of the circuit breaker 10. The bell alarm switch assembly 82 may be directly mounted to the housing 12 or, preferably is mounted to the base portion 43 of support frame 42 similar to the mounting of the trip indicator assembly 40. Preferably, the bell alarm switch assembly 82 is mounted adjacent the trip indicator assembly 40 so as to act in cooperation therewith to indicate the trip status of the circuit breaker 10. In FIGS. 6 and 7 the cover 44 of the trip indicator assembly 40 is removed so as to better illustrate the invention.

The bell alarm switch assembly 82 includes bell alarm switches 84 and 85, which may be of any type microswitch as is known for indicating whether the circuit breaker has tripped. The bell alarm switches 84 and 85 are secured to the base 43, or alternatively to the housing 12, by pins 86 which engage apertures in the switches 84 and 85. The bell alarm switches 84 and 85 are actuated by levers 88 and 89, respectively, which depress plungers 90 and 91 as is generally known. Leads 87 extend from the bell alarm switches 84 and 85 to send a signal to a remote location indicating the trip status of the circuit breaker 10. FIG. 6 shows the levers 88 and 89 depressing the plungers 90 and 91. In contrast, FIG. 7 shows the levers 88 and 89 extending away from the plungers 90 and 91 so that the bell alarm switches 84 and 85 may send a signal indicating that a trip has occurred.

The bell alarm switch assembly 82 also includes a bell alarm actuator, generally designated by the reference numeral 92, for actuating the bell alarm switches 84 and 85. As shown, the bell alarm actuator 92 is operatively connected by a cross bar 94 to the shaft 50 of the trip indicator assembly 40. Accordingly, this allows for the bell alarm actuator 92 to actuate the bell alarm switches 84 and 85 responsive to the shaft 50 moving from the cocked position (FIG. 6) to the trip position (FIG. 7) in which a signal is sent indicating that a trip has occurred. Specifically, this is accomplished by the bell alarm actuator means 92 having an elongated slide member 96 connected to the cross bar 94 so as to be slidable in response to the shaft 50 moving from the cocked position to the trip position. The slide member 96 includes a first lateral extension 97 and a second lateral extension 98 for cooperating with the levers 88 and 89. When the shaft 50 is in the cocked position, the first and second lateral extensions 97 and 98 are held against the levers 88 and 89, respectively, in order to depress the plungers 90 and 91 (FIG. 6). While in this position, the bell alarm switches 84 and 85 do not send a signal indicating that the circuit breaker 10 has tripped. However, when the shaft 50 moves to the trip position, the first and second lateral extensions 97 and 98 are allowed to move away from the levers 88 and 89. This is a result of the slide member 96 being connected through cross bar 94 to the shaft 50 as described herein. Fixed guide post 99 and second sidewall 47 act to guide the second lateral extension 98 when the slide member 96 is moving from the cocked position to the trip position. It will be appreciated that movement of the first and second lateral extensions 97 and 98 and the resulting movement of the levers 88 and 89 results in the plungers 90 and 91 expanding and the bell alarm switches 84 and 85 sending a signal indicating the circuit breaker 10 has been tripped.

The bell alarm switch assembly 82 provides an effective means for signalling or indicating the trip status of the circuit breaker 10 as a result of the snap action provided by the bell alarm actuator 92 as described herein. By combining the bell alarm switch assembly 82 with the trip indicator assembly 40, an instantaneous snap-action is provided by the bell alarm actuator means 92. Of course, it will be appreciated that the bell alarm switch assembly 82 may be employed with the mechanism of the trip indicator assembly 40 without the indicator end 68 of shaft 50 being provided for protruding through the front cover 16 to indicate that a trip has occurred.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

an electrically insulative housing;

separable electrical contacts disposed within said housing and moveable between a closed position and an open position;

an operating mechanism for closing, opening, and tripping open said separable electrical contacts;

a trip unit for sensing an electrical condition of said separable electrical contacts, said trip unit capable of sending a trip signal in response to a predetermined electrical condition;

a trip actuating mechanism operatively connected to said operating mechanism, said trip actuating mechanism capable of receiving said trip signal and actuating said operating mechanism in response thereto in order to trip open said separable electrical contacts; and a trip indicator assembly mounted to said housing of the circuit breaker for indicating the trip status of the circuit breaker, said trip indicator assembly comprising:

a spring powered shaft, said spring powered shaft moveable between a cocked position and a trip position in which said spring powered shaft protrudes through said housing of the circuit breaker;

means for releasably retaining said spring powered shaft in said cocked position;

a release rod, said release rod having a first end operatively connected to said trip actuating mechanism of the circuit breaker, said release rod being movable in response to actuation of said trip actuating mechanism, said release rod further having a second end positioned adjacent said spring powered shaft, said second end engaging said spring powered shaft following actuation of said trip actuating mechanism and movement of said release rod so as to release said spring powered shaft from engagement with said means for releasably retaining resulting in movement of said spring powered shaft to said trip position.

2. The circuit breaker of claim 1 further including an additional actuating mechanism, actuation of said additional actuating mechanism also actuating said operating mechanism; and wherein said trip actuating mechanism includes a rotatable tripper platform operatively connecting said first end of said release rod to said trip actuating mechanism, said rotatable tripper platform rotating so as to actuate said operating mechanism in response to said trip actuating mechanism receiving said trip signal, said rotatable tripper platform not rotating when said additional actuating mechanism actuates said operating mechanism.

3. The circuit breaker of claim 2 wherein said rotatable tripper platform includes a lost motion coupling providing for lost motion between said release rod and said trip actuating mechanism, said lost motion coupling allowing the trip actuating mechanism to actuate said operating mechanism in order to trip open said separable electrical contacts prior to said rotatable tripper platform causing said release rod to be moved.

4. The circuit breaker of claim 1 further including a rigid link member for operatively connecting said first end of said release rod to said trip actuating mechanism.

5. The circuit breaker of claim 4 wherein said rigid link member includes a lost motion coupling providing for lost motion between said release rod and said trip actuating mechanism, said lost motion coupling allowing the trip actuating mechanism to actuate said operating mechanism in order to trip open said separable electrical contacts prior to said rigid link member causing said release rod to be moved.

6. The circuit breaker of claim 1 wherein said means for releasably retaining said spring powered shaft in said cocked position includes a catch surface formed on said housing of the circuit breaker; and said spring powered shaft includes an annular flange for engaging said catch surface and maintaining said spring powered shaft in said cocked position.

7. The circuit breaker of claim 6 wherein said second end of said release rod includes a lateral projection, said lateral projection engaging said annular flange following actuation of said trip actuating mechanism and movement of said release rod so as to laterally displace said annular flange in a first direction and release said annular flange from engagement with said catch surface resulting in movement of said spring powered shaft to said trip position.

8. The circuit breaker of claim 7 wherein said housing includes a cam surface extending therefrom, said cam surface being positioned to laterally displace said annular flange in a second direction opposite to said first direction when resetting said spring powered shaft from said trip position to said cocked position resulting in the engagement between the annular flange and said catch surface for maintaining said spring powered shaft in said cocked position.

9. The circuit breaker of claim 1 further including at least one bell alarm switch capable of signalling the trip status of the circuit breaker; and wherein said trip indicator assembly includes a bell alarm actuator means for actuating said at least one bell alarm switch.

10. The circuit breaker of claim 9 wherein said bell alarm actuator means is operatively connected to said spring powered shaft for actuating said at least one bell alarm switch responsive to said spring powered shaft moving from said cocked position to said trip position.

11. A trip indicator assembly for indicating the trip status of a circuit breaker, the circuit breaker including a housing and a trip actuating mechanism, the trip indicator assembly mounted to the housing, said trip indicator assembly comprising:

a spring powered shaft, said spring powered shaft moveable between a cocked position and a trip position in which said spring powered shaft protrudes through the housing of the circuit breaker;

means for releasably retaining said spring powered shaft in said cocked position;

a release rod, said release rod having a first end operatively connected to the trip actuating mechanism of the circuit breaker, said release rod being movable in response to actuation of the trip actuating mechanism, said release rod further having a second end positioned adjacent said spring powered shaft, said second end engaging said spring powered shaft following actuation of the trip actuating mechanism and movement of said release rod so as to release said spring powered shaft from engagement with said means for releasably retaining resulting in movement of said spring powered shaft to said trip position.

12. The assembly of claim 11 further including a rigid link member for operatively connecting said first end of said release rod to said trip actuating mechanism.

13. The assembly of claim 12 wherein said rigid link member includes a lost motion coupling providing for lost motion between said release rod and said trip actuating mechanism, said lost motion coupling allowing the trip actuating mechanism to actuate said operating mechanism in order to trip open said separable electrical contacts prior to said rigid link member causing said release rod to be moved.

14. The assembly of claim 11 further including at least one bell alarm switch capable of signalling the trip status of the circuit breaker; and wherein said trip indicator assembly includes a bell alarm actuator means for actuating said at least one bell alarm switch.

15. The assembly of claim 14 wherein said bell alarm actuator means is operatively connected to said spring powered shaft for actuating said at least one bell alarm switch responsive to said spring powered shaft moving from said cocked position to said trip position.

16. The assembly of claim 11 wherein said means for releasably retaining said spring powered shaft in said cocked position includes a catch surface formed on the housing of the circuit breaker; and said spring powered shaft includes an annular flange for engaging said catch surface and maintaining said spring powered shaft in said cocked position.

17. The assembly of claim 16 wherein said second end of said release rod includes a lateral projection, said lateral projection engaging said annular flange following actuation of said trip actuating mechanism and movement of said release rod so as to laterally displace said annular flange in a first direction and release said annular flange from engagement with said catch surface resulting in movement of said spring powered shaft to said trip position.

18. The assembly of claim 17 wherein said housing includes a cam surface extending therefrom, said cam surface being positioned to laterally displace said annular flange in a second direction opposite to said first direction when resetting said spring powered shaft from said trip position to said cocked position resulting in the engagement between the annular flange and said catch surface for maintaining said spring powered shaft in said cocked position.

19. A circuit breaker comprising:

an electrically insulative housing;

separable electrical contacts disposed within said housing and moveable between a closed position and an open position;

an operating mechanism for closing, opening, and tripping open said separable electrical contacts;

a trip unit for sensing an electrical condition of said separable electrical contacts, said trip unit capable of sending a trip signal in response to a predetermined electrical condition;

a trip actuating mechanism operatively connected to said operating mechanism, said trip actuating mechanism capable of receiving said trip signal and actuating said operating mechanism in response thereto in order to trip open said separable electrical contacts; and a bell alarm switch assembly mounted to said housing of the circuit breaker for signalling the trip status of the circuit breaker, said bell alarm switch assembly comprising:

at least one bell alarm switch;

a spring powered shaft, said spring powered shaft moveable between a cocked position and a trip position;

means for releasably retaining said spring powered shaft in said cocked position;

a release rod, said release rod having a first end operatively connected to said trip actuating mechanism of the circuit breaker, said release rod being movable in response to actuation of said trip actuating mechanism, said release rod further having a second end positioned adjacent said spring powered shaft, said second end engaging said spring powered shaft following actuation of said trip actuating mechanism and movement of said release rod so as to release said spring powered shaft from engagement with said means for releasably retaining resulting in movement of said spring powered shaft to said trip position; and a bell alarm actuator means for actuating said at least one bell alarm switch, said bell alarm actuator means being operatively connected to said spring powered shaft for actuating said at least one bell alarm switch responsive to said spring powered shaft moving from said cocked position to said trip position.

20. The circuit breaker of claim 19 further including an additional actuating mechanism, actuation of said additional actuating mechanism also actuating said operating mechanism; and wherein said trip actuating mechanism includes a rotatable tripper platform operatively connecting said first end of said release rod to said trip actuating mechanism, said rotatable tripper platform rotating so as to actuate said operating mechanism in response to said trip actuating mechanism receiving said trip signal, said rotatable tripper platform not rotating when said additional actuating mechanism actuates said operating mechanism.

21. The circuit breaker of claim 20 wherein said rotatable tripper platform includes a lost motion coupling providing for lost motion between said release rod and said trip actuating mechanism, said lost motion coupling allowing the trip actuating mechanism to actuate said operating mechanism in order to trip open said separable electrical contacts prior to said rotatable tripper platform causing said release rod to be moved.

22. The circuit breaker of claim 19 further including a rigid link member for operatively connecting said first end of said release rod to said trip actuating mechanism.

23. The circuit breaker of claim 22 wherein said rigid link member includes a lost motion coupling providing for lost motion between said release rod and said trip actuating mechanism, said lost motion coupling allowing the trip actuating mechanism to actuate said operating mechanism in order to trip open said separable electrical contacts prior to said rigid link member causing said release rod to be moved.

24. The circuit breaker of claim 19 wherein said means for releasably retaining said spring powered shaft in said cocked position includes a catch surface formed on said housing of the circuit breaker; and said spring powered shaft includes an annular flange for engaging said catch surface and maintaining said spring powered shaft in said cocked position.

25. The circuit breaker of claim 24 wherein said second end of said release rod includes a lateral projection, said lateral projection engaging said annular flange following actuation of said trip actuating mechanism and movement of said release rod so as to laterally displace said annular flange in a first direction and release said annular flange from engagement with said catch surface resulting in movement of said spring powered shaft to said trip position.

26. The circuit breaker of claim 25 wherein said housing includes a cam surface extending therefrom, said cam surface laterally displacing said annular flange in a second direction opposite to said first direction when resetting said spring powered shaft from said trip position to said cocked position resulting in the engagement between the annular flange and said catch surface for maintaining said spring powered shaft in said cocked position.

* * * * *